US005404284A

United States Patent [19]

Davis, Jr.

[11] Patent Number: 5,404,284

[45] Date of Patent: Apr. 4, 1995

[54] LIGHT FIXTURE FOR A CEILING FAN

[75] Inventor: William S. Davis, Jr., Fort Worth, Tex.

[73] Assignee: Davoil, Inc., [illegible], Tex.

[21] Appl. No.: 149,924

[22] Filed: Nov. 10, 1993

[51] Int. Cl.[6] ..... F21V 29/00

[52] U.S. Cl. ..... 362/294; 362/96; 362/147; 362/408; 415/5

[58] Field of Search ..... 362/96, 408, 147, 249, 362/294, 404, 299, 184; 416/5

[56] References Cited

U.S. PATENT DOCUMENTS

| | | | |
|---|---|---|---|
| 4,313,153 | 1/1982 | Davis | 362/147 |
| 4,342,073 | 7/1982 | Ranten | 362/294 |
| 4,531,179 | 7/1985 | Baker . | |
| 4,796,166 | 1/1989 | Greenberg . | |
| 4,831,505 | 5/1989 | Van Norman . | |
| 5,079,684 | 1/1992 | Lai | 362/408 |

*Primary Examiner*—James C. Yeung

*Attorney, Agent, or Firm*—James E. Bradley; Grady K. Bergen

[57] ABSTRACT

A light fixture for mounting to the switch housing of a ceiling fan is provided for giving the light fixture an integral appearance with the ceiling fan. The light fixture has a hollow base which has an upper surface and a bottom which are spaced apart. The upper surface of light fixture is defined by a periphery which is surrounded by an upper portion of the base. The upper portion and upper surface define a recess for receiving the lower portion of the switch housing. In another embodiment, a light pan is mounted to the bottom of the base. The light pan is a circular member having a lower surface and a substantially flat inner portion. The pan is provided with an upwardly extending outer flange located around the periphery. The pan has a diameter which is substantially greater than the width of the base so that the base is not visible when viewed from below. A light or lights are attached to the lower surface of the light pan.

19 Claims, 3 Drawing Sheets

LIGHT FIXTURE FOR A CEILING FAN

BACKGROUND OF THE INVENTION

1. Field of the Invention

This invention relates to a light fixture for mounting to a ceiling fan.

2. Description of the Prior Art

Ceiling fans have been used for several years for circulating air with in a room. The ceiling fans are usually mounted to an electrical outlet formed in the ceiling of the type usually adapted for light fixtures. Because the ceiling fan is substituted for any light fixture which would otherwise be mounted to the ceiling, light fixtures designed specifically for ceiling fans have been used which mount to the ceiling fan instead of the ceiling.

A ceiling fan usually consists of a motor housing from which as set of radially extending fan blades extend therefrom. Mounted below the fan blades is a switch housing. The switch housing is usually cylindrical in shape and has a flat, circular bottom or lower portion. Most prior art ceiling fan light fixtures, such as the light fixture shown in FIG. 2, consist of a base having a flat upper surface which abuts against the lower surface of the switch housing of the ceiling fan. These light fixtures are usually fastened to the base by means of a protruding threaded rod which extends from the upper surface of the light fixture and through a threaded aperture or opening in the bottom of the switch housing.

Difficulty often arises when mounting these prior art light fixtures to the ceiling fan. It is often difficult to determine when the threaded rod is aligned with the aperture in the switch housing during installation. As a result, the person installing the light fixture will sometimes slide the threaded rod over the lower surface of the switch housing until the threaded rod is aligned or received with in the threaded aperture.

In some ceiling fans or light fixtures, it is sometimes necessary to remove a lower plate of the switch housing in order to facilitate mounting of the light fixture to the ceiling fan.

Prior art light fixtures, as those shown in FIG. 2, also have the appearance of being a separate and distinct attachment to the ceiling fan. The diameter of the base of the light fixture which attaches to the switch housing is often smaller than that of the switch housing. Because the upper surface of the light fixture is flat and abuts directly against the lower surface of the switch housing, a definite demarcation exists which distinguishes the ceiling fan from the attached light fixture.

What is needed is a light fixture which attaches to the ceiling fan which is easy to install and has the appearance of being an integral part of the ceiling fan so that it does not appear as a separate attached fixture.

SUMMARY OF THE INVENTION

A light fixture for mounting to the switch housing of a ceiling fan is provided and allows for easy installation and gives the light fixture an integral appearance with the ceiling fan. The light fixture has a hollow base which has an upper surface and a bottom which are spaced apart. The base has an upper portion which surrounds the periphery of the upper surface. The upper portion and upper surface define a recess for receiving the lower portion of a switch housing. Fastening means are provided for fastening the base to the switch housing and electrical illumination means are attached to the exterior of the base.

In another embodiment, a light pan is mounted to the bottom of the base. The light pan is a circular member having a lower surface and a substantially flat inner portion. The pan is provided with an upwardly extending outer flange located around the periphery. The pan has a diameter which is substantially greater than the width of the base so that the base is not visible when viewed from below. A light socket is provided on the lower surface of the pan for engaging an electric light bulb. A translucent light transmission housing covers the light socket. Coupling means is also provided with the pan for securing the light transmission housing to the lower surface.

DETAILED DESCRIPTION OF THE INVENTION

Figure 1:
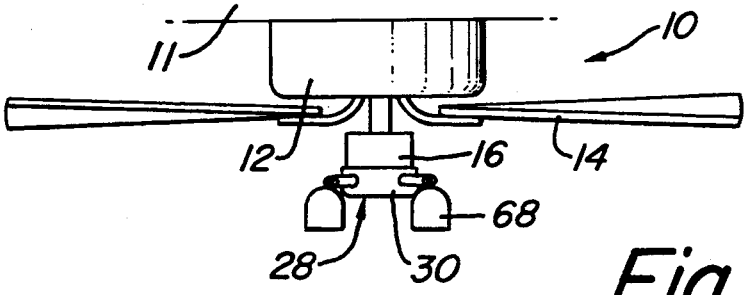
FIG. 1 is a side view of a ceiling fan shown with a light fixture of the invention attached and constructed in accordance with the invention.

Referring to FIG. 1, a ceiling fan 10 which is mounted to a ceiling 11 has a motor housing 12. A set of radially extending fan blades 14 extends from the bottom of the motor housing 12. Extending downward from the motor housing 12 and located below the fan blades 14 is a switch housing 16. The switch housing 16 is cylindrical in shape and has a flat bottom.

Figure 2:
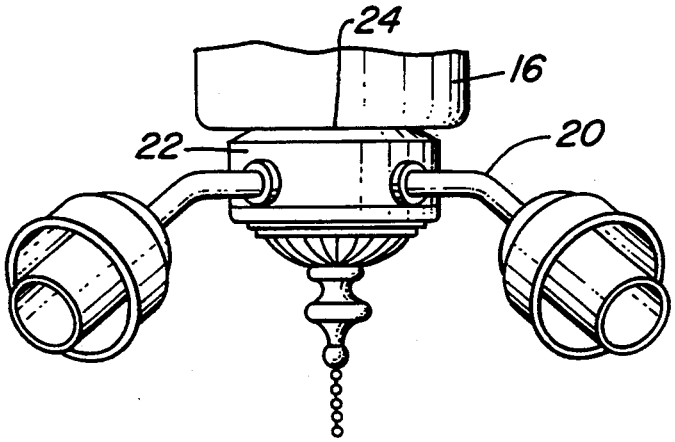
Fig. 2 (PRIOR ART)
FIG. 2 is a side view of a prior art light fixture shown mounted to a switch housing of a ceiling fan.

FIG. 2 shows a ceiling fan light fixture 20 of the prior art. The prior art light fixture 20 consists of a base 22 having a flat upper surface 24 which abuts against the lower surface of the switch housing 16 of the ceiling fan 10. Because the light fixture 20 merely abuts the lower surface of the switch housing 16 of the ceiling fan 10, there is a definite demarcation between the light fixture 20 and the ceiling fan 10.

Figure 3:
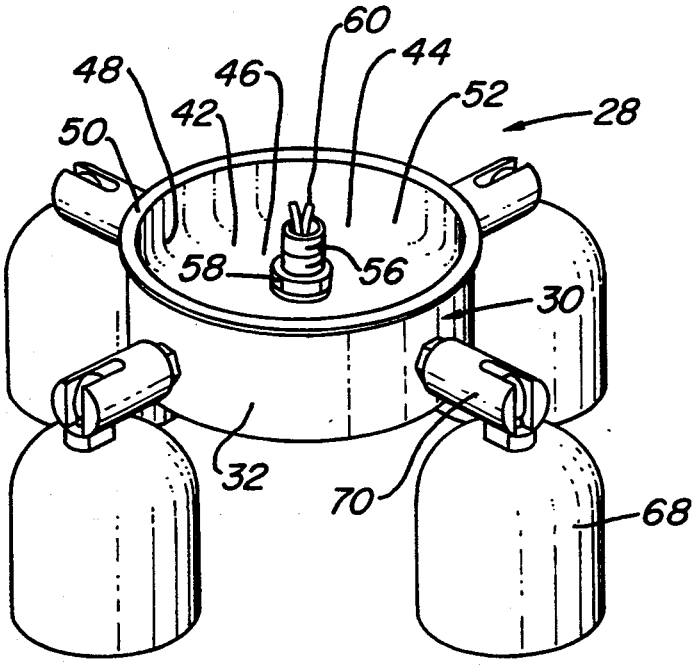
FIG. 3 is a perspective view of a light fixture constructed in accordance with the invention.

The light fixture of the invention, however, gives the light fixture an integral appearance with the ceiling fan. Referring to FIGS. 1 and 3, the light fixture 28 of the invention is provided with a cylindrical base 30. The base 30 is formed from a hollow cylinder 32 which extends circumferentially around and is parallel to a longitudinal axis of the base 30. The upper portion of the cylinder 32 terminates to define a circular upper edge or rim 34 (FIG. 4).

Figure 4:
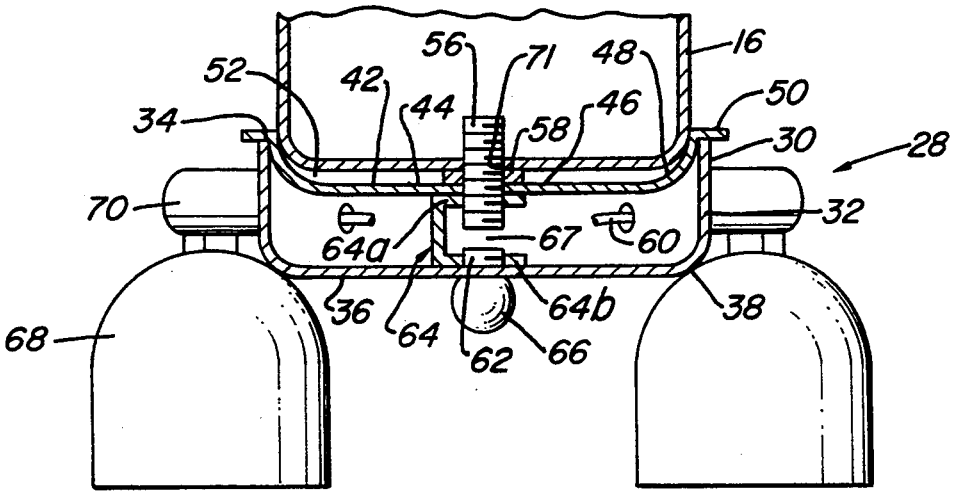
FIG. 4 is a cross-sectional side view of the light fixture of FIG. 3 shown mounted to a switch housing of a ceiling fan.

Referring to FIG. 4, a circular bottom plate 36 is joined along an annular outer periphery 38 to the lower end of the cylinder 32. The outer periphery 38 of the bottom plate 36 is curved gradually upward and is integral with the lower end of the cylinder 32. The bottom plate 36 lies in a plane perpendicular to the longitudinal axis of the base 30.

An upper plate 42 having an upper surface 44 is located opposite the bottom plate 36 at the other end of the cylinder 32 and is spaced a distance apart from the bottom plate 36. The upper plate 42 has a substantially flat center portion 46 which is in a plane parallel to the bottom plate 36. An annular curved portion 48 curves gradually upward and outward from the periphery of the flat center portion 46. At the outer most extent of the curved portion 48 is an outwardly protruding lip 50 which extends radially outward from the curved portion 48. The flat center portion 46 and curved area 48 define a recess 52 having a depth of approximately three-eighths to one-half of an inch deep and a sufficient width to closely receive the lower portion of the switch housing 16.

The upper plate 42 is seated against the cylinder 32 with the outwardly protruding lip 50 contacting the upper edge 34 of the cylinder 32. When so seated, the upper edge 34 of the cylinder 32 is located above the flat center portion 46 of the upper surface 44.

Referring to FIG. 3, an externally threaded coupling rod 56 is threaded into a hole formed in the center of the upper plate 42. The threaded coupling rod 56 is hollow and forms a passageway through the plate 42 so wiring 60 from the switch housing 16 can be passed therethrough into the hollow interior of the base 30. A threaded nut 58 is threaded over the upper portion of the threaded coupling rod 56 so that it abuts against the upper surface 44 of the upper plate 42.

As shown in FIG. 4, another threaded rod 62 extends through a hole in the bottom plate 36. The threaded rods 56, 62 are concentric with the longitudinal axis of the base 30. Located with in the hollow interior of the base 30 is a C-shaped connecting bracket 64 having an upper arm 64A and a lower arm 64B. The upper end of the threaded rod 62 extends into the interior of the base 22 and is threaded into the lower arm 64B of the connecting bracket 64. An internally threaded cap 66 is threaded over the lower end of the threaded rod 62 and abuts the lower surface of the bottom plate 36.

The lower end of the threaded coupling rod 56 is threaded into the upper arm 64A of the connecting bracket 64. By tightening the threaded cap 66 and nut 58 on the coupling rods 62, 56, respectively, the upper plate 42 can be forced against the cylinder 32 so that the upper plate 42 and cylinder 32 are effectively joined together to form the base 30.

A gap 67 between the ends of the threaded coupling rods 56, 62 joined to the connecting bracket 64 allows the wiring 60 to be passed from the switch housing 16 through the interior of the base 30 to electric lights 68. The lights 68 are connected to the exterior of the base 30 by means of mounting arms 70.

Installation of the ceiling fan light fixture 28 is as follows. In most conventional ceiling fans, the switch housing 16 has a threaded aperture 71 which usually holds a threaded plug (not shown). The threaded plug is removed from the aperture 71 and the upper portion of the threaded coupling rod 56 is threaded into the aperture 71. Because the recessed portion 52 is designed to fit around the exterior of the switch housing 16, when the coupling rod 56 is completely threaded into the aperture 71, the lower surface of the switch housing 16 will abut against the nut 58. Optionally, the nut 58 maybe removed so that the lower portion of the switch housing 16 is in a close abutting relationship with the upper plate 42.

The wiring of the light fixture 20 to the switch housing 16 is accomplished by conventional methods such as those used in prior art light fixtures. Wiring 60 extends from the light fixture 20 through the coupling rod 56 to the switch housing 16. A switch mechanism or switch means may be mounted to the base 30 in a conventional manner. The switch mechanism is not shown in the figures.

Figure 6:
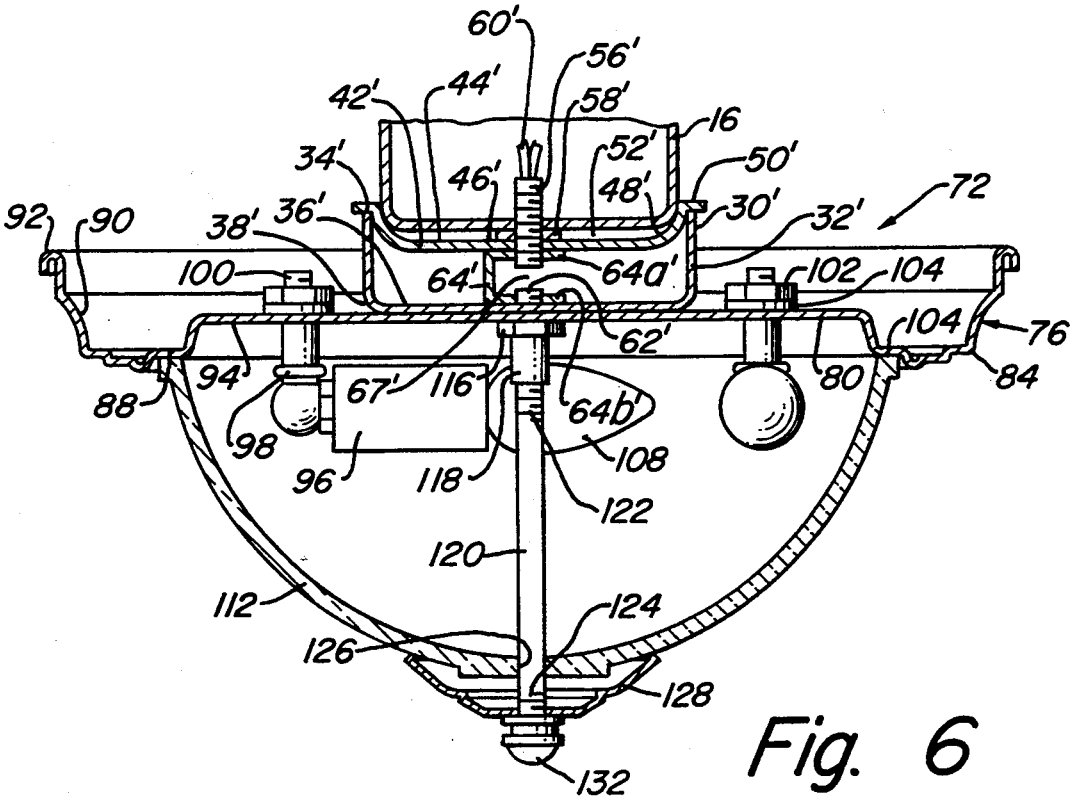
FIG. 6 is a cross-sectional side view of the light fixture of FIG. 5 shown mounted to a switch housing of a ceiling fan.
Figure 5:
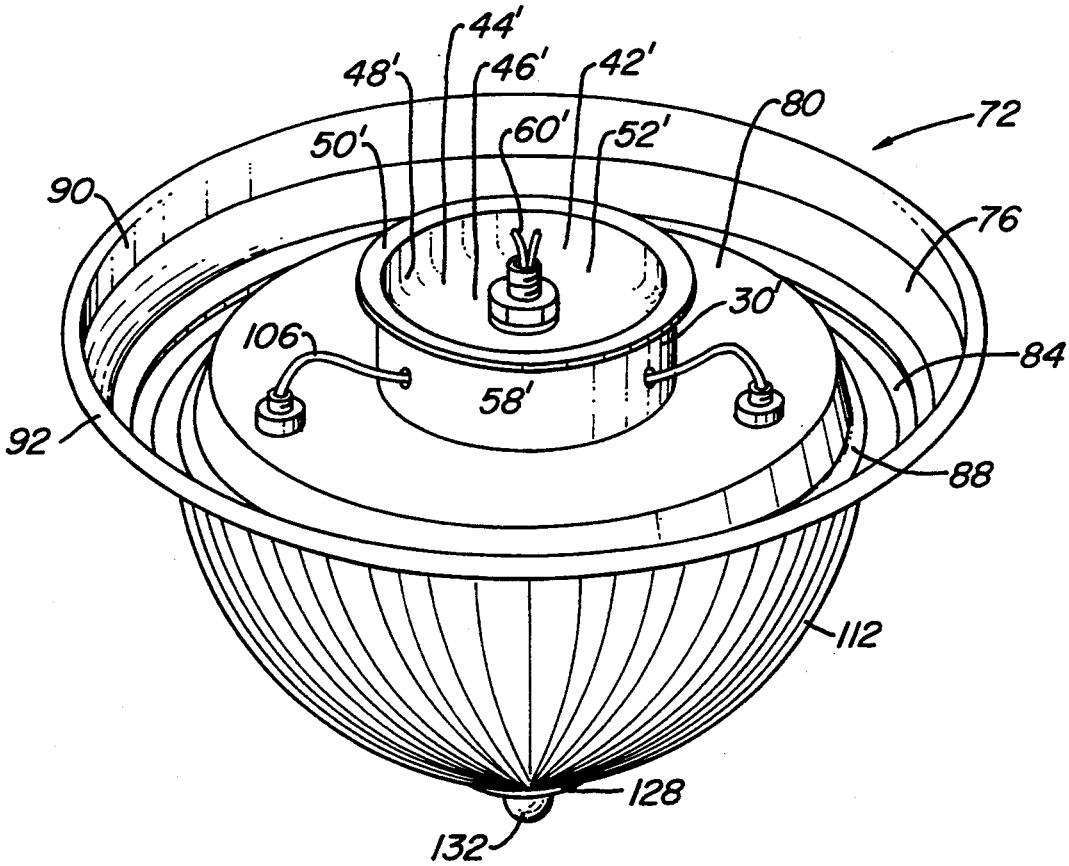
FIG. 5 is a perspective view of another embodiment of the light fixture constructed in accordance with the invention.

In another embodiment, as shown in FIGS. 5 and 6, a light fixture 72 is provided with a base 30'. The base 30' is constructed substantially in the same manner as the base 30 shown in FIGS. 3 and 4. Components of the base 30' which are similar to the components of base 30 are designated with a prime sign.

The light fixture 72 of FIGS. 5 and 6 consists of the base 30' to which a light pan 76 is mounted to the bottom of the bottom plate 36'. The pan 76 is a circular member having a lower surface and a substantially flat inner portion 80. An annular stepped ridge 84 extends around the flat inner portion 80 and is provided with an inner shoulder 88 which is adjacent to the inner portion 80. The flat inner portion 80 has a diameter which is equal or greater than the width of the bottom plate 36' of the base 30'.

An annular outer flange 90 is joined to the radial outer portion of the annular stepped ridge 84 and is integrally joined there with. The outer flange 90 extends upward in the direction of the base 30' and is radially spaced outward from the base 30' and longitudinally overlapping at least a portion of the base 30'. The outer flange 90 terminates at an upper edge on which a curled lip 92 is formed.

At least one light socket 96 is joined to the lower surface of the pan 76 by means of a collar 98. The collar 98 is threaded internally for coupling to a threaded rod 100 which extends through the flat inner portion 80 of the pan 76. A nut 102 and washer 104 assembly join the collar 98 and light socket 96 to the pan 76. The threaded rod 100 has an axially extending passage which allows wiring 106 to extend from the base 30' for providing electrical current to the light socket 96 for a light bulb 108. The wiring extends through holes located in the cylinder 32' of the base 30'.

A translucent light transmission housing 112 is fastened to the pan 76. The light transmission housing 112 is substantially bowl shaped. As seen in FIG. 6, a rim 114 of the light housing 112 abuts the annular inner shoulder 88 of the pan 76 and is seated thereon.

The lower threaded rod 62' protrudes through the center of the inner portion 80. A nut 116 secures the pan 76 to the bottom plate 36' of the base 30'. Although not shown, the lower threaded rod 62' extends for a distance beyond the nut 116 so that an internally threaded sleeve 118 can be secured at one end to that portion of the threaded rod 62' which extends from the nut 116.

A threaded rod 120 is provided having upper and lower threaded ends 122, 124. The upper threaded end 122 is threaded into the other end of the threaded sleeve 118 opposite the threaded rod 62'. The lower end 124 of the threaded rod 120 extends through an aperture 126 formed in the center of the light transmission housing 112 and through a retaining member 128. The retaining member 128 is substantially disc-shaped and conforms to the exterior of the light transmission housing 112. An internally threaded cap 132 is threaded over the protruding end 124 of the threaded rod 120 which extends through the aperture 126 and the retaining member 128. The cap 132 forces the retaining member 128 against the exterior of the light transmission housing 112 so that the rim 114 of the light transmission housing 112 rests against the inner shoulder 88 of the pan 76.

The light fixture 72 is similar to the light fixture 28 as shown in FIGS. 3 and 4. However, the pan 76 of the light fixture 72 generally obscures the connection of the base 30' and the switch housing 16 of the ceiling fan 10 when viewed from below.

The invention as described above has several advantages over the light fixtures of the prior art. The recessed portion of the base makes it easier to align the threaded rod with the aperture in the switch housing. It is not necessary to remove a lower plate of the switch housing in order to install the light fixture. The center plug of the switch housing is merely discarded and the threaded coupling rod is threaded into the aperture remaining in the lower portion of the switch housing. Because the lower portion of the switch housing is located in the recessed portion of the base, an integral appearance is created where the base appears to be integrally formed with the switch housing of the ceiling fan. By providing a pan, as shown in the embodiment of FIGS. 5 and 6, the entire connection between the base of the light fixture and the switch housing can be entirely obscured from view when viewed from below.

While the invention has been shown in only one of its forms, it should be apparent to those skilled in the art that it is not so limited, but is susceptible to various changes without departing from the scope of the invention.

I claim:

1. A light fixture for mounting to a ceiling fan, the ceiling fan having a motor housing, a set of fan blades extending radially from the motor housing and a switch housing having a lower portion mounted below the motor housing, the light fixture comprising in combination:

a hollow base having an upper surface and a bottom which are spaced apart, the upper surface being defined by a periphery and being recessed with in the base to define a recessed portion for receiving the lower portion of the switch housing of the ceiling fan;

fastening means for fastening the base to the switch housing; and electrical illumination means attached to the exterior of the base.

2. The light fixture of claim 1, wherein:

the base is substantially cylindrical in shape.

3. The light fixture of claim 1, wherein:

the base has an upper portion which surrounds the periphery of the upper surface, the upper portion having an upper edge, the upper surface having a curved portion located along the periphery which curves upward and joins the upper edge of the upper portion.

4. The light fixture of claim 3, wherein:

the upper surface is flat.

5. The light fixture of claim 1, wherein the fastening means comprises:

a threaded coupling rod protruding upward from the center of the upper surface which is configured to couple the light fixture to the switch housing of the ceiling fan.

6. In a ceiling fan having a motor housing, a set of fan blades extending radially from the motor housing, a cylindrical switch housing having a lower portion mounted below the motor housing, and a light fixture mounted to the switch housing, the light fixture comprising in combination:

a hollow, cylindrical base having an upper surface and a bottom which are spaced apart, the upper surface being defined by a periphery, the cylindrical base having an upper portion which surrounds the periphery of the upper surface, the upper portion having an upper edge, the upper surface curving upward and joining the upper edge of the upper portion, the upper portion and upper surface defining a recess for receiving the lower portion of the switch housing of the ceiling fan;

a threaded coupling rod protruding upward from the center of the upper surface configured to couple the light fixture to the switch housing of the ceiling fan; and electrical illumination means attached to the exterior of the base.

7. The ceiling fan of claim 1, wherein:

the upper surface is flat.

8. A light fixture for mounting to a ceiling fan, the ceiling fan having a motor housing, a set of fan blades extending radially from the motor housing and a cylindrical switch housing having a lower portion mounted below the motor housing, the light fixture comprising in combination:

a hollow base having an upper surface and a bottom which are spaced apart from each other;

fastening means for fastening the base to the lower portion of the switch housing;

a pan which mounts to the bottom of the base, the pan being a circular member having a lower surface, a substantially flat inner portion and an upwardly extending outer flange located around a periphery of the inner portion, the pan having a diameter which is substantially greater than the width of the base;

at least one light socket coupled to the lower surface of the pan for engaging an electric light bulb;

a translucent light transmission housing having an exterior, the light transmission housing mounting over the light socket; and coupling means for securing the light transmission housing to the lower surface of the pan.

9. The light fixture of claim 8, wherein:

the light transmission housing is substantially bowl shaped.

10. The light fixture of claim 8, wherein:

the light transmission housing has a width which is substantially larger than the width of the base.

11. The light fixture of claim 8, wherein the coupling means is comprised of:

a threaded member joined to the pan which extends downward from the center of the lower surface;

a rod having upper and lower threaded ends, the upper end of the rod being coupled to the threaded member and the lower end of the rod extending through an opening in the light transmission housing; and a retaining member which couples to the lower end of the rod and is in an abutting relation ship with the exterior of the light transmission housing so that the light transmission housing is secured to the pan.

12. A light fixture for mounting to a ceiling fan, the ceiling fan having a motor housing, a set of fan blades extending radially from the motor housing and a cylindrical switch housing having a lower portion mounted below the motor housing, the light fixture comprising in combination:

a base having an upper surface and a bottom which are spaced apart, the upper surface being defined by a periphery, the base having an upper portion which surrounds the periphery of the upper surface, the upper portion having an upper edge, the upper portion and upper surface defining a recess for receiving the lower portion of the switch housing of the ceiling fan;

fastening means for fastening the base to the lower portion of the switch housing;

a pan which mounts to the bottom of the base, the pan being a circular member having a lower surface, a substantially flat inner portion and an upwardly extending outer flange located around a periphery of the inner portion, the pan having a diameter which is substantially greater than the width of the base;

at least one light socket coupled to the lower surface of the pan for engaging an electric light bulb;

a translucent light transmission housing having an exterior, the light transmission housing mounting over the light socket; and coupling means for securing the light transmission housing to the lower surface of the pan.

13. In a ceiling fan having a motor housing, a set of fan blades extending radially from the motor housing and a cylindrical switch housing having a lower portion mounted below the motor housing, a light fixture comprising in combination:

a hollow base having and an upper surface and a bottom which are spaced apart, the upper surface being defined by a periphery, the base having an upper portion which surrounds the periphery of the upper surface, the upper portion having an upper edge, the upper portion and upper surface defining a recess for receiving the lower portion of the switch housing of the ceiling fan, the base having a width;

fastening means for fastening the base to the switch housing so that the lower portion of the switch housing is received with in the recess;

a pan which mounts to the bottom of the base, the pan being a circular member having a lower surface, a substantially flat inner portion and an upwardly extending outer flange located around a periphery of the inner portion, the pan having a diameter which is substantially greater than the width of the base;

at least one light socket coupled to the lower surface of the pan for engaging an electric light bulb;

a translucent light transmission housing having an exterior, the light transmission housing mounting over the light socket; and coupling means for securing the light transmission housing to the lower surface.

14. The light fixture of claim 13, wherein:

the light transmission housing is substantially bowl shaped.

15. The light fixture of claim 13, wherein the coupling means comprises:

a threaded member joined to the pan which protrudes from the center of the lower surface;

a rod having upper and lower threaded ends, the upper end of the rod being coupled to the threaded member and the lower end of the rod extending through an opening in the light transmission housing; and a retaining member which couples to the lower end of the rod and is in an abutting relationship with the exterior of the light transmission housing so that the light transmission housing is secured to the pan.

16. The light fixture of claim 13, wherein:

the base is substantially cylindrical in shape.

17. The light fixture of claim 13, wherein:

the upper surface has a curved portion near the periphery of the upper surface which curves upward and joins the upper edge of the upper portion of the base.

18. The light fixture of claim 13, wherein the fastening means comprises:

a threaded rod protruding from the center of the upper surface configured to couple the light fixture to the switch housing of the ceiling fan.

19. The light fixture of claim 13, wherein:

the light transmission housing has a width which is substantially larger than the width of the base.

* * * * *